United States Patent [19]

Huggins

[11] 4,176,504

[45] Dec. 4, 1979

[54] WEATHER PROOF SANDWICH PANEL FLOOR ATTACHMENT DEVICE

[76] Inventor: Jack G. Huggins, R.D. #2, Box 415, Berlin, Camden County, N.J. 08009

[21] Appl. No.: 935,483

[22] Filed: Aug. 21, 1978

[51] Int. Cl.[2] ..... E04D 3/38; E02D 27/00

[52] U.S. Cl. ..... 52/61; 52/264; 52/293

[58] Field of Search ..... 52/61, 97, 264, 293

[56] References Cited

U.S. PATENT DOCUMENTS

| | | | |
|---|---|---|---|
| 1,950,519 | 3/1934 | Ripley | 52/97 |
| 2,061,633 | 11/1936 | Muller | 52/97 |
| 2,724,465 | 11/1955 | Kraus et al. | 52/61 |
| 3,101,820 | 8/1963 | Snyder et al. | 52/316 X |
| 3,170,269 | 2/1965 | Dunnington | 52/293 |
| 3,182,767 | 5/1965 | Kuehl | 52/293 X |
| 3,282,007 | 11/1966 | Campbell et al. | 52/205 X |
| 3,334,455 | 8/1967 | Russell . | |
| 3,357,144 | 12/1967 | Chauveau et al. | 52/97 |
| 3,388,514 | 6/1968 | Archinal et al. | 52/97 |
| 3,411,252 | 11/1968 | Boyle, Jr. | 52/290 X |
| 3,529,393 | 9/1970 | Wilkins | 52/731 |
| 3,712,004 | 1/1973 | Loebsack | 52/265 |
| 3,785,913 | 1/1974 | Halamore | 52/309.11 X |
| 3,952,462 | 4/1976 | Heise | 52/293 |

FOREIGN PATENT DOCUMENTS

| | | | |
|---|---|---|---|
| 246802 | 9/1963 | Australia | 52/593 |
| 797416 | 7/1958 | United Kingdom | 52/264 |

*Primary Examiner*—Alfred C. Perham
*Attorney, Agent, or Firm*—Thomas A. Lennox

[57] ABSTRACT

A weather proof attachment device to connect sandwich panel wall system modules to concrete floors including a bracket under the wall with an upright rail connected to the inside facia sheet of the sandwich panel and an outside inverted U-shape rail extending into the interior core of the panel, the groove to receive the edge of a protection sheet from below extending from the bracket across the surface of the concrete and over the corner of the slab to prevent weather and rain from entering therein.

9 Claims, 3 Drawing Figures

WEATHER PROOF SANDWICH PANEL FLOOR ATTACHMENT DEVICE

BACKGROUND OF THE INVENTION

This invention is directed to the construction o buildings and in particular the construction of buildings with modular panels.

Because of the spiralling cost of building construction, it has for many years been the trend to construct buildings of modular units which are manufactured away from the ultimate erection site. Because of standard sizes and the ease of handling, there have been many systems which have contemplated the use of sandwich panels which provide not only the exterior surface of sufficient strength and quality to resist the weather, but also the necessary interior panel of durability and esthetic appearance necessary for the building interior design. It has been contemplated that this panel would have as its core a material of sufficient insulating properties to provide the essentially equivalent of standard building construction in terms of heat and sound protection.

Although not the only disclosure of this kind, L. G. Hallamore in U.S. Pat. No. 3,785,913 discloses a structural panel having an inner skin of plywood or plasterboard and an external sheet of plywood, metal or the like sandwiching a polystyrene foam inner core. In U.S. Pat. No. 3,101,820, M. K. Snyder, et al, discloses a window structure for use in buildings constructed of similar panels.

A number of attachment devices have been disclosed to connect these panels to the floor and all appear to be directed to interior use. These attachment procedures are disclosed in U.S. Pat. No. 3,282,007 to H. F. Campbell et al., 3,334,455 to G. C. Russell, and 3,411,252 to W. J. Boyle, Jr.

It is apparent that a major limiting factor in the use of this type of panels for the exterior construction of buildings has been difficulty in attaching these panels to the floor in a weather-tight fashion. None of the above attachment means would suffice and until my invention, the use of these panels to construct the exterior shell of buildings has been severely limited.

W. B. Wilkins in U.S. Pat. No. 3,529,393 discloses a wall to floor connector beams which has a U cross-sectional shape. In U.S. Pat. No. 3,182,767 T. J. Kuehl discloses a shower cabinet construction, which must of necessity be water tight but the construction is entirely different than my invention. A building construction system is disclosed in U.S. Pat. No. 3,712,004 to Victor H. Loebsak which discloses a metal flashing member is similar to that utilized in present building construction.

None of these connecting systems disclose the present invention or satisfy the objects as follows:

It is an object of this invention to provide an attachment device to connect sandwich building panels to the floor such that the exterior bottom edge will be sealed to the weather.

It is an additional object of this invention to provide an attachment system to connect sandwich panels having an interior sheet and an exterior sheet with an insulation core to a floor base, such as a concrete slab or foundation.

It is a further object of this invention to provide a weather sealing attachment of sandwich panels affixed near an edge of the base floor or foundation exposed to the weather to prevent water from being driven under the panel and into the interior of the building.

It is an additional object of this invention to provide a high strength reinforced lower edge of the sandwich panel which when the panel is secured to the base bracket of this invention will provide a structurally sound and weather proof system of attachment.

It is an additional object of this invention to provide an attachment system for sandwich panels which can easily be handled without skilled labor and will essentially be independent of the care of installation.

It is an additional object of this invention to provide an attachment system which can effectively seal sandwich panels of handleable size along their lower edges to the floor or foundation and will allow multiple units attached side by side in a weather proof fashion.

These and other objects have been attained in the present invention which accomplishes the needs described above.

SUMMARY OF THE INVENTION

The attachment device for weather proof attachment of sandwich panels to a floor base includes two basic parts, first a bracket and second a protection sheet. The use of this device contemplates the availability of sandwich panels constructed of two facia sheets, one exterior sheet and one interior sheet sandwiching a core. It is important to this invention and is an element that the core does not extend to the bottom of the facia sheets such that a cavity or void is formed sufficient for the bracket to extend vertically into the void upon attachment to the floor base. The term "floor base" is intended to include not only concrete floors such as reinforced concrete slabs and the like, but also includes foundations which may be constructed of poured concrete, cinder blocks with a suitable cap and the like. The attachment device is intended for use on a floor base that has at least one edge along the periphery of that base exposed to the weather.

The bracket is a significant length of the bottom edge of the sandwich panel and in fact, it is preferred that it be longer than that bottom panel edge so that any interruption of continuity of the bracket does not correspond with the abutting edges of the adjacent panels. The bracket includes a base member extending horizontally at the position on which the sandwich panel is to be constructed with a width extending a sufficient distance horizontally from the outside surface of the interior facia sheet of the sandwich panel to a distance facing the other edge under the cavity in the sandwich panel near the inside surface of the exterior facia sheet of the sandwich panel. A vertical rail extends upwardly along the edge under the position outside the surface of the interior facia sheet the length of the base member of such a shape that it extends upwardly along the outside surface of the interior facia sheet. On the edge of the base member near the exterior facia sheet an inverted U-shape rail is structurally connected along that edge such that it is in a position to extend upwardly into the cavity in the sandwich panel with the outside member of the inverted U-shape near the inside surface of the exterior facia sheet. A protection sheet is provided with one edge extending into the groove of the inverted U-shape rail and of such a width as to extend from the position of that U-shape rail along the surface of the floor base and over the edge of the exterior exposed corner of the floor base. An attachment system is used to structurally connect the bracket to the floor base, such as a common bolt and anchor system. A second attachment system is provided to structurally connect the sandwich panels to the bracket, such as with pop rivets.

DESCRIPTION OF PREFERRED EMBODIMENTS

Figure 1:
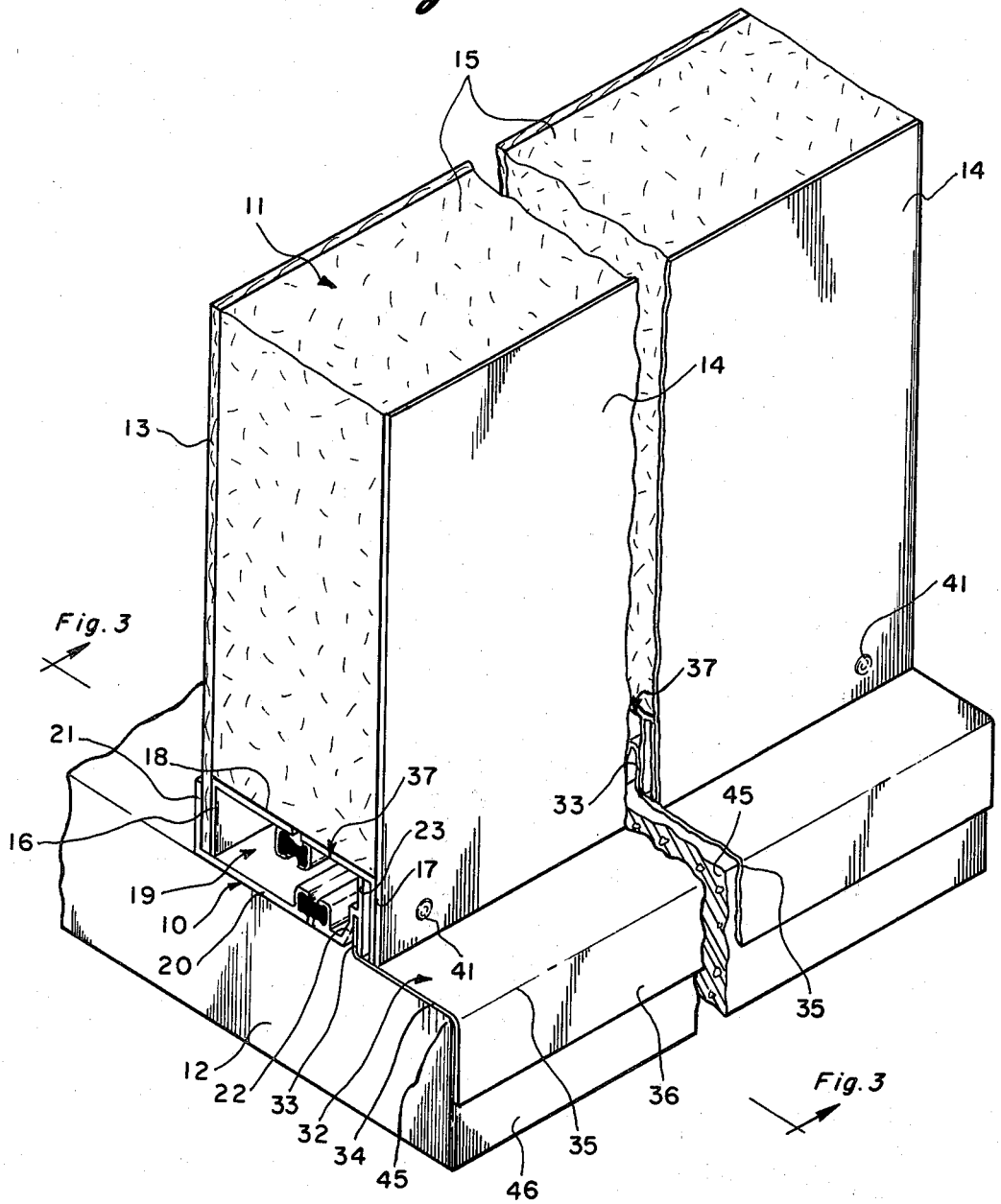
FIG. 1 is a perspective view of the attachment system of this invention connecting a sandwich building panel to a base floor looking from the exterior exposed side.

While the basic attachment device of my invention is the base bracket and protection sheet described in the Summary hereinabove, it is preferred that the inverted U-shape rail be limited in height such that there is some room inside the core for a further vertical extension on the top of and along the length of the inverted U-shape. It is then possible to more easily attach the exterior facia sheet, by means of rivets, metal screws, or the like to the base bracket through that vertical extension. It will be apparent that this extension is not necessary as attachment can be made directly to the outside element of the inverted U-shape with the use of metal screws or pop rivets into the inverted U-shape or even through both sides of the inverted U-shape. However, the extra vertical extension is preferred.

In addition, for highest quality structures and for the best structural strength, it is preferred that an additional reinforcement bracket be included in the attachment system. This reinforcement bracket is generally limited in length to that of the bottom edge of the sandwich panel, and would generally be attached to the panel during its manufacture. It is contemplated that this reinforcing bracket might be adhesively attached to the bottom edge of the panel during its manufacture. It is not necessary that t be structurally attached as the attachment of the panel to the base bracket through the reinforcement bracket will provide the structural strength of attachment of all of the various parts. This reinforcement bracket has a cross-sectional U-shape and is attached in the inverted position between the facia sheets and in a cavity caused by not continuing the core to the bottom edge of the sheets. The attachment of this reinforcement bracket will have the advantage of preventing inadvertent damage to the bottom edge and corners of the panel during shipping and handling.

It is also preferred that the brackets be insulated from heat transfer from the outside facia to the inside facia panel. This may be accomplished by inclusion of a heat insulating member extending the length of the brackets.

It is generally preferred that the base bracket not have its ends terminate at the ends of the sandich panels being attached. This bracket is generally the length of the entire exterior wall; that is ten to twenty-four feet in length. In addition, it is preferred that the protection sheet be of a length such that it does not terminate at the vertical wall joints or at any points where the base bracket terminates. It is preferred that the protection sheet be formed from a roll of sheet. However shorter lengths can be overlapped and sealed to form a fully weather proof system.

As will be apparent, the protection sheet is formed into an approximate Z-shape in its final position. The sheet is installed such that one extension of the Z is placed in the inverted U-shape of the base bracket and the length of that extension must be equal to or less than the depth of the U-shape of the bracket. Further, the middle portion of the Z-shape must be sufficient to extend along the surface of the base floor or foundation to and past the outside edge of that base. The outside extension of the Z-shape extends over the corner and downwardly over that edge. It is contemplated that this protection sheet might be supplied in an L-shape cross-sectional sheet. The short end of the L-shape would be pre-formed to fit within the inverted U-shape of the base bracket and the longer edge (width) would be chosen to fit common structures. The width of the protection sheet may vary depending upon the distance the installer wishes to place the wall from the outside edge corner of the base. When the protection sheet is provided in an L-shape, it will be necessary for the installer to bend the sheet over the exterior corner of the base, but allow some variance in the distance the wall is attached from that outside edge from job to job.

In FIG. 1, base bracket 10 is shown connecting wall sandwich panel 11 to concrete floor 12. In this view, the near edge of the panel and floor have been sectioned off to illustrate the internal construction but it should be understood that it is unlikely that the panel would ever be exposed in this fashion.

Wall sandwich panel 11 is reduced in size vertically to easily illustrate this invention and is constructed of a 4 foot by 8 foot interior facia sheet 13, which together with exterior facia sheet 14 sandwiches core 15. The construction of the sandwich panel is not critical to this invention as it is merely necessary that it be constructed in a fashion such to receive on the bottom edge the inverted U-shape and the extra vertical extension if preferred. Typical construction for interior facia sheet 13 would include plastic sheet, wood paneling, fiberboard with vinyl covering, plasterboard, plywood and the like. Typical materials suitable for exterior facia sheet 14 include aluminum sheet, steel sheet, plastic sheet, and the like, generally coated to prevent corrosion and formed in a shape or pattern of pleasing appearance. Core 15 is preferably polystyrene foam, but may be constructed of any suitable material including other polymeric foams such as polyurethane foam, paper honeycomb, foamed glass and other inorganic materials and the like. The preferred construction is an interior facia of plywood panel and an exterior facia of coated aluminum adhesively bonded to a core of polystyrene foam.

Concrete floor 12 may merely be a foundation footing that need not extend inwardly to form the floor. When using the base bracket 10 it is intended that it be located near outside corner 45 and outside edge 46 which are exposed to the elements which my device is to protect against.

Figure 2:
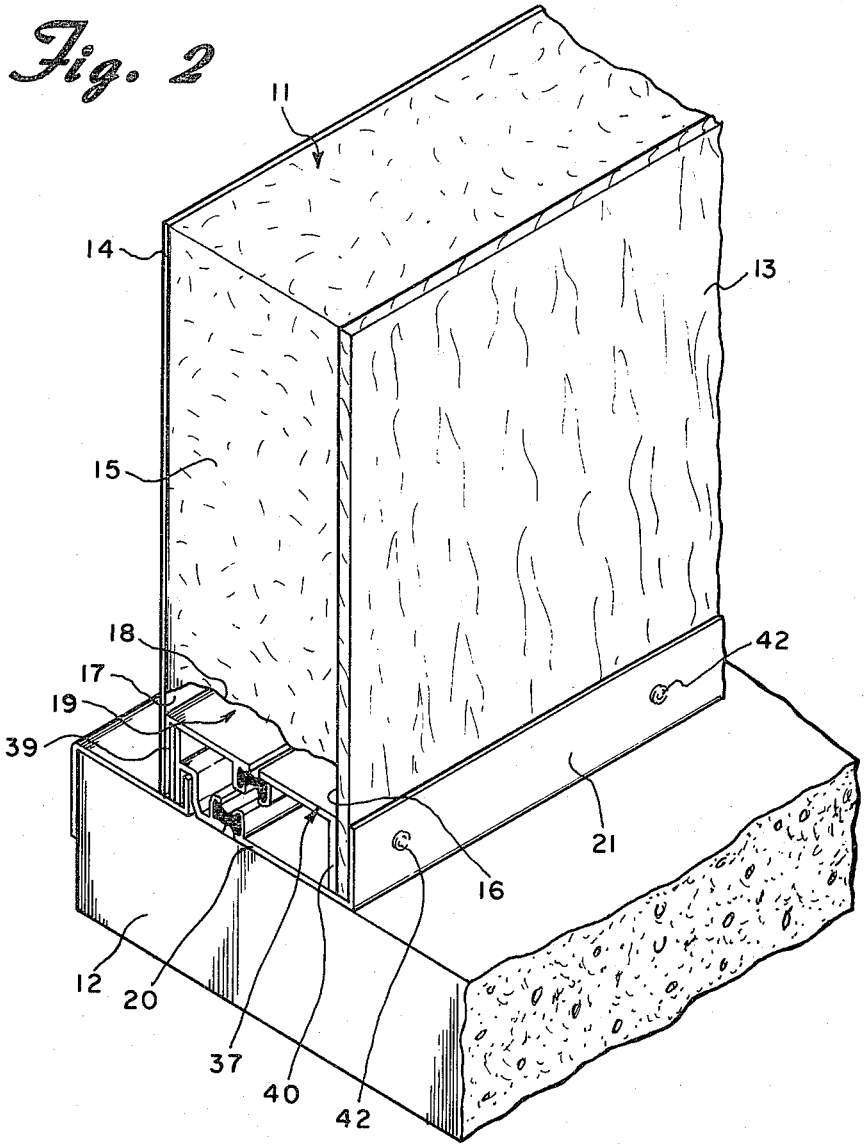
FIG. 2 is a perspective view of the attachment system of this invention connecting a panel to a floor looking from the interior exposed side.

In wall sandwich panel 11, a cavity or void is provided formed by the inside surface 16 of interior facia sheet 13, inside surface 17 of exterior facia sheet 14 and the termination 18 of core 15 to form void 19. The exact shape of this void is not critical as long as it provides sufficient space for insertion of bracket 10 and is more clearly shown on FIG. 2.

Base bracket 10 is extruded aluminum and includes base 20 which extends from the outside surface of interior facia sheet 13 to void 19 and near inside surface 17 of sheet 14. Base member 20 extends lengthwise under panel 11 and neighboring panels not shown. Member 20 terminates on one edge with inside vertical upright rail 21 which preferably abuts the outside surface of interior facia sheet 13 in a pleasing and efficient fashion so it will act as a kick plate. Base member 20 terminates on its opposite edge by connecting to inverted U-shape 22 on top of which is extended vertical interior rail 23.

Figure 3:
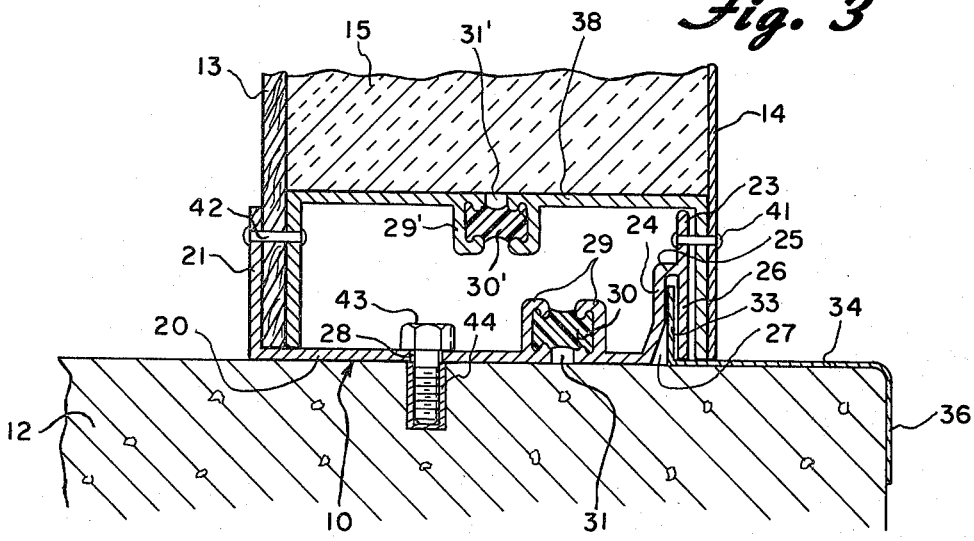
FIG. 3 is a cross-sectional view along Lines 3—3 of FIG. 1.

Protection sheet 32 has vertical upright edge 33 extending into space 27 of inverted U-shape 22 as is more clearly shown in FIG. 3. Protection sheet 32 extends horizontally as intermediate portion 34 which extends to corner 45 and is formed as bend 35 to downward extension 36 over outside edge 46. Protection sheet 32 may be formed on the site or preformed in an L-shape or even a Z-shape of aluminum, steel, galvanized metal or the like and may be chosen to match or color coordinate with the exterior surface of facia sheet 14.

Sandwich panel 11 is reinforced on its lower edge with bracket 37 which is generally a U-shape aluminum extrusion adhesively attached to the panel in an inverted position. When the reinforcing bracket 37 is utilized, void 19 is of shape to allow bracket 37 to be entirely hidden within the facia sheets 13 and 14.

Wall panel 11 is attached to the bracket system by rivets 41 extending through and connecting exterior sheet 21 and vertical interior rail 23 sandwiching shoulder 39 of reinforcing bracket 37. Similarly, rivets 42 connect through inside rail 21, interior facia sheet 14 and shoulder 40 of reinforcing bracket 37 as shown in FIG. 3.

Reinforcing bracket 37 includes base 38 which extends the length of the bottom edge of panel 11 and is the width of core 15 and has shoulders 39 and 40 adhesively attached to inside surfaces 17 and 16 respectively.

As shown in the cross-sectional view of FIG. 3 base bracket 10 is attached by hole 28 in base member 20 by bolt 43 threaded into anchor 44 imbedded in concrete 12. As more clearly shown in FIG. 3, bracket 10 has base member 20 extending past interior facia sheet 13 and connecting to inside rail 12. On the opposite edge of base member 20 is structurally connected invert-U-shape 22 which includes upright member 24, top 25 and downward member 26 forming groove 27 which extends the length of bracket 10. It is into this groove 27 that vertical upright edge 33 of protection sheet 32 is inserted and held in position upon connection bracket 10 to the floor. Downward member 26 holds the intermediate portion 34 of sheet 32 to floor 12. In both base bracket 10 and reinforcing bracket 37 heat conduction insulators are provided. These insulators are formed by providing channels 29 and 29' in the brackets during extrusion. Thereafter, insulating plastic 30 and 30' is allowed to flow into the respective channels. Finally grooves 31 and 31' are cut through the metal the length of the bracket preventing effective heat conduction across the bracket.

While I have described my invention in connection with specific embodiments, it is to be clearly understood that this description is made only by way of example and not of limitation to the scope of my invention as setforth in the following claims.

I claim:

1. A device for weather proof attachment of walls comprising sandwich panels of two facia sheets, one exterior and one interior sheet around a core which does not extend to the bottom of the facia sheets forming a cavity along the bottom edge of each panel, the attachment being to a floor base having at least one edge along the periphery of the base exposed to the weather comprising:

(a) a base bracket means extending along the length of the walls under the bottom edge of the sandwich panels comprising:

(1) a base horizontal member extending along the floor base under the bottom edge of the sandwich panels with a width extending from the outside surface of the interior facia sheet to a position under the cavity in the panel near the inside surface of the exterior facia sheet, (2) an inside upright vertical rail along the length of the base member in a position and shape to extend upwardly along the outside surface of the interior facia sheet, and (3) a groove means structurally connected to and extending along the length of the edge of the base member under and extending upwardly into the panel cavities, forming a vertical groove along the bottom of the bracket means, (b) a protection sheet extending along the length of the bracket formed such that one edge engages in the groove means, (c) a first attachment means structurally attaching the bracket means to the floor base, and (d) a second attachment means structurally connecting the sandwich panels to the bracket means wherein one edge of the protection sheet is held in the groove means of the bracket, the intermediate portion of the sheet rests on the surface of the floor base and the outside edge of the protection sheet extends over and around the exterior exposed corner of the floor base.

2. The attachment device of claim 1 wherein an outside vertical rail the length of the base bracket means extends upwardly from the top of the groove means of the base bracket near the inside surface of the exterior facia sheet to facilitate ease of structural attachment to the exterior facia sheet.

3. The attachment device of claim 2 wherein the attachment means of the panel to the base bracket are rivet means, first through the inside upright rail, the interior facia sheet and second through the exterior facia sheet and the outside vertical rail of the bracket means.

4. The attachment device of claim 1 wherein the groove means is inverted U-shaped rail structurally connected along the edge under the cavity in the panels of a shape to extend into the cavity near the inside surface of the exterior facia sheet.

5. The attachment device of claim 1 wherein a second bracket having a U-shaped cross-sectional shape and a length that of the individual sandwich panels with outside dimensions approximately that of the inside dimensions of the cavity along the bottom edge of the panel and wherein the second bracket is attached to the lower edge of the inside surfaces of the facia sheets.

6. The attachment device of claim 5 wherein the attachment means of the facia panel to the bracket comprises a rivet means, first rivet connection through the inside upright rail, the interior facia sheet and the second bracket, and second by connection through the exterior facia sheet, the second bracket and through an upright extension rail from the top of the groove means of the bracket means.

7. The device of claim 1 wherein all of the bracket means have an insulation strip constructed along their entire length.

8. The device of claim 1 wherein the lengths of the base bracket mean and the protection sheet are approximately that of the walls.

9. A device for weather proof attachment of walls comprising sandwich panels of an exterior facia sheet and an interior facia sheet sandwiching an insulating core which is constructed to allow a cavity along the bottom edge of each panel, the attachment being to a floor base having at least one edge exposed to the weather comprising:

(a) a base bracket extending under the wall under the bottom edge of the sandwich panels comprising:

(1) a base horizontal member extending along the floor base under the bottom edge of the sandwich panels with a width extending from the interior facia sheet to a position under the cavity in the panel near the inside surface of the exterior facia sheet, (2) an inside upright vertical rail extending along the edge of the base member in a position and shape to extend upwardly and abutt against a surface of the interior facia sheet, (3) an inverted U-shaped rail is structurally connected along the outside edge of the base member extending upwardly into the panel cavities forming a vertical groove along the bottom of the bracket means, and (4) an inside vertical rail the length of the base bracket structurally connected and extending upwardly from the top of the inverted U-shaped rail near the inside surface of the exterior facia sheet, (b) a protection sheet extending the length of the base bracket formed such that one edge engages in the vertical groove from below with an intermediate portion of the sheet resting and extending over the surface of the floor base and extending over and around the exterior exposed corner of the floor base, (c) a first attachment means structurally attaching the bracket means to the floor base, and (d) a second attachment means structurally connecting the sandwich panels to the bracket means comprising a first connection through the inside upright rail, the interior facia sheet and the second bracket, and a second connection through the exterior facia sheet, the second bracket and through the outside vertical rail.

* * * * *